US009332337B2

(12) United States Patent
Ridler

(10) Patent No.: US 9,332,337 B2
(45) Date of Patent: May 3, 2016

(54) HEADSET WITH MAGNETICALLY ATTACHED EAR PAD

(71) Applicant: GN Netcom A/S, Ballerup OT (DK)
(72) Inventor: Bettina Ridler, Virum (DK)
(73) Assignee: GN Netcom A/S (DK)

( * ) Notice: Subject to any disclaimer, the term of this patent is extended or adjusted under 35 U.S.C. 154(b) by 217 days.
(21) Appl. No.: 14/014,744
(22) Filed: Aug. 30, 2013
(65) Prior Publication Data
US 2013/0343565 A1 Dec. 26, 2013

Related U.S. Application Data
(63) Continuation of application No. 13/203,968, filed as application No. PCT/DK2009/000056 on Mar. 2, 2009, now abandoned.

(51) Int. Cl.
*H04R 25/00* (2006.01)
*H04R 1/10* (2006.01)
*H04R 1/12* (2006.01)
*H04R 5/033* (2006.01)
(52) U.S. Cl.
CPC ..... *H04R 1/1066* (2013.01); *H04R 1/1058* (2013.01); *H04R 1/1008* (2013.01); *H04R 1/12* (2013.01); *H04R 5/033* (2013.01)
(58) Field of Classification Search
CPC ... H01R 1/1008; H01R 1/1066; H01R 1/1058
See application file for complete search history.

(56) References Cited

U.S. PATENT DOCUMENTS 4,302,635 A * 11/1981 Jacobsen ..... H04R 1/1058 381/371
4,572,324 A * 2/1986 Fidi ..... H04R 1/1008 181/129
4,689,822 A * 8/1987 Houng ..... H04R 1/1066 381/371
4,958,697 A * 9/1990 Moody ..... A42B 3/166 181/129
5,138,722 A 8/1992 Urella et al.
6,163,615 A * 12/2000 Callahan ..... H04R 1/1008 381/371
6,295,366 B1 * 9/2001 Haller ..... H04R 5/0335 379/430
6,856,690 B1 2/2005 Skulley
2005/0181675 A1 8/2005 Kim
2006/0222197 A1 * 10/2006 Tsunoda ..... H04R 1/12 381/371
2011/0002475 A1 * 1/2011 Kimura ..... H04R 1/1008 381/71.6
2011/0286607 A1 * 11/2011 Kimura ..... G10K 11/1788 381/71.6
2014/0126763 A1 * 5/2014 Yoo ..... A61F 11/14 381/371

FOREIGN PATENT DOCUMENTS

JP 06 078386 3/1994
JP 678386 3/1994
TW 200911005 3/2009

OTHER PUBLICATIONS

First Office Action issued by the SIPO on Jul. 29, 2013 for CN application No. 200980157777.6 with English translation.

* cited by examiner

*Primary Examiner* — Matthew Eason
(74) *Attorney, Agent, or Firm* — Altera Law Gorup, LLC

(57) ABSTRACT

A headset (1) comprising at least one earphone (2, 3) with at a first earphone side (39) and earphone attachment means (14) for detachably attaching an ear pad (8) with co-operating ear pad attachment means (16) to the first earphone side (39). The headset (1) further comprising a wearing device (4) for attaching the headset (1) to the head of a user, such that the first earphone side (39) faces the ear. The earphone attachment means comprise magnetic elements (14), such that an ear pad (8) with co-operating magnetic ear pad attachment means (15) can be magnetically attached to the earphone (2, 3). The invention also relates to such an ear pad (8).

17 Claims, 5 Drawing Sheets

HEADSET WITH MAGNETICALLY ATTACHED EAR PAD

TECHNICAL FIELD

The invention relates to a headset comprising at least one earphone with a first earphone side and earphone attachment means for detachably attaching an ear pad with co-operating ear pad attachment means to the first earphone side, and where the headset further comprising a wearing device for attaching the headset to the head of a user, such that first earphone side faces the ear.

BACKGROUND ART

Many headsets or headphones are provided with replaceable ear pads or ear cushions, as these are subject to wear and becomes dirty by extensive use. Therefore, it is possible to substitute the ear pads with new ones.

The Jabra GN 9120 is a headset according to the preamble of claim 1. The ear pad is ring-shaped and comprises an inner ring, which together with a protrusion with an undercut on the earphone provides a "snap" solution. Other headsets provide other mechanical attachment means for detachably attaching the ear pad to the earphone.

DISCLOSURE OF INVENTION

The object of the invention is to provide an easy and efficient way of attaching and detaching an ear pad to and from an earphone of a headset.

The headset according to the preamble is characterized in that the earphone attachment means comprise magnetic elements, such that an ear pad with co-operating magnetic ear pad attachment means can be magnetically attached to the earphone. With such a solution, it is very easy to attach the ear pad to the earphone and detach it again. This provides the following advantages. At call centres there are often several users sharing one headset (work in shift). If it was fast and simple to change the cushions, each user could have their own private set to put on in the beginning of their shift. It would be more hygienic and give the user a better experience using the headset. In addition, dirty cushions are to take off and clean, e.g. under water.

With the term "magnetic elements" is meant elements of materials, which can be magnetized or are strongly attracted to a magnet. In most cases, these materials are ferromagnetic. Ferromagnetic materials include iron, nickel, cobalt, some rare earth metals and some of their alloys. At least one of the magnetic elements must be a permanent magnet. Permanent magnets are made from "hard" ferromagnetic materials, which stay magnetized. "Soft" ferromagnetic materials like soft iron are attracted to a magnet but do not tend to stay magnetized.

A headset according to the invention may further comprise an ear pad with magnetic ear pad attachment means.

According to an embodiment, the ear pad attachment means comprises a magnetic ear pad attachment element of ferromagnetic material extending along the periphery of a first ear pad side, which faces the first earphone side, when the ear pad is attached to earphone.

According to an embodiment, the periphery of the first ear pad side is circular and the ear pad attachment element is ring-shaped. In this case, it is not necessary for the user to orient the ear pad in a certain direction in order to attach it to the earphone.

According to a preferred embodiment, the earphone attachment means comprise one ore more permanent magnets. In this case, the ear pad attachment element(s) can be made of soft ferromagnetic materials like soft iron or steel.

According to the invention, the earphone attachment means can comprise a number of permanent magnets arranged around a sound passage at the first earphone side. With such an arrangement, it is easier to obtain a firm magnetic attachment of the ear pad to the earphone.

Preferably, the earphone and the ear pad comprise mechanical positioning means for preventing mutual displacement in a direction parallel with first earphone side and the first ear pad side. This ensures that the ear pad and the earphone are aligned in attached condition.

In a very simple embodiment, the earphone and/or the ear pad comprise one ore more protrusions that lies outside the outer periphery of the other of the earphone or ear pad in the attached condition.

Typically, the mechanical positioning means comprises a protrusion and a co-operating recess.

According to an embodiment, the ear pad comprises a ring-shaped ear cushion. Thus, the ring-shaped ear cushion surrounds a hole leading audio from the earphone to the ear.

According to an embodiment, the wearing device is a headband or neckband, wherein the headset comprises two earphones interconnected by the wearing device. Alternatively, the headset may comprise a headband or neckband and only one earphone.

The invention also relates to an ear pad for an earphone, said ear pad comprises ear pad attachment means for detachably attaching the ear pad to an earphone with co-operating earphone attachment means. The ear pad according to the invention is characterized in that the ear pad attachment means comprises at least one magnetic element, such that it can be magnetically attached to an earphone with co-operating magnetic earphone attachment means.

BRIEF DESCRIPTION OF THE DRAWINGS

The invention is explained in detail below with reference to the drawing illustrating a preferred embodiment of the invention and in which.

Figure 1:
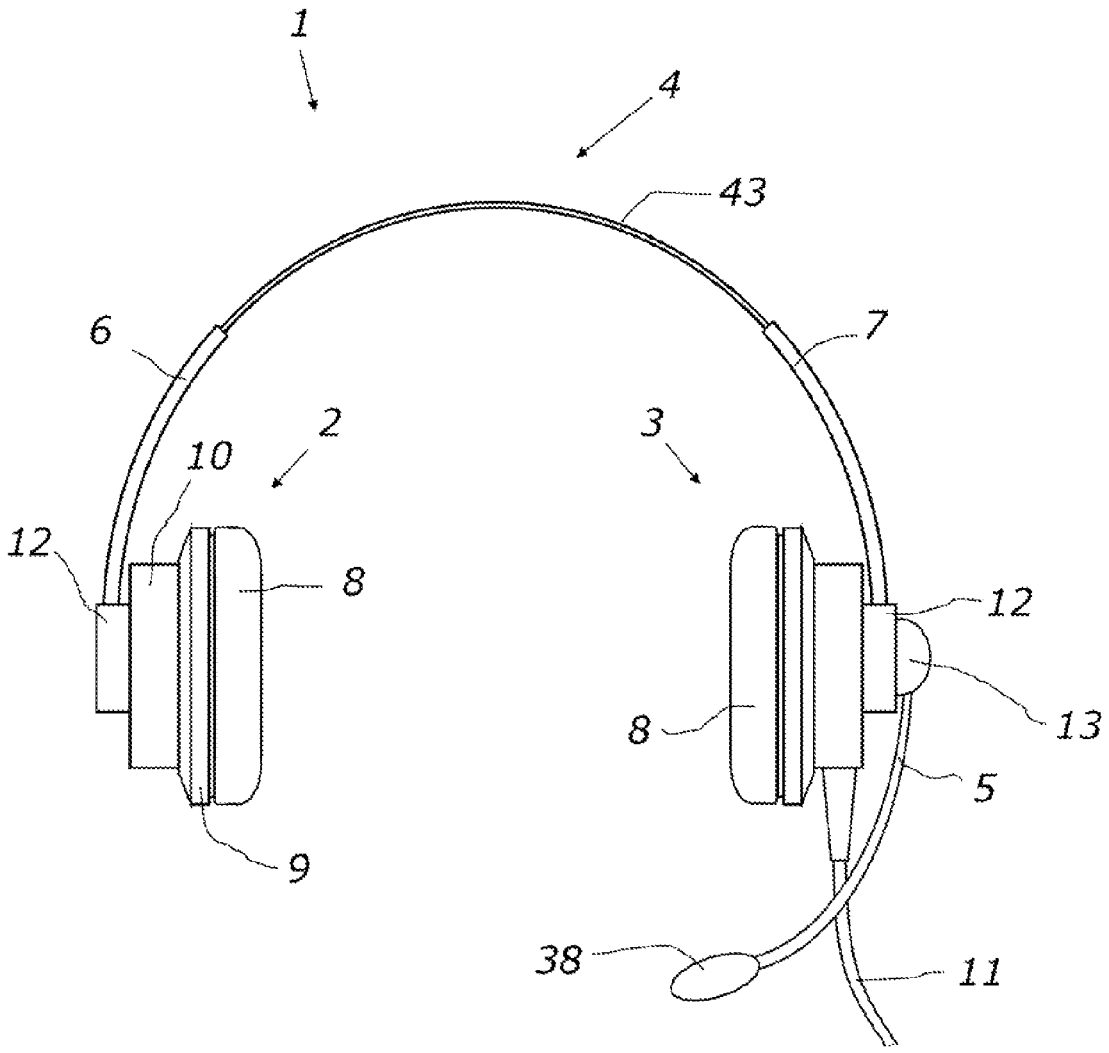
FIG. 1 is a front view of a preferred embodiment of a headset according the invention.

The following reference signs are used in the figures and the following detailed description of the preferred embodiment.

| | |
|---|---|
| 1 | headset |
| 2 | right earphone |

-continued

| | |
|---|---|
| 3 | left earphone |
| 4 | headband |
| 5 | microphone arm |
| 6 | first headband part |
| 7 | second headband part |
| 8 | ear pad |
| 9 | ear plate |
| 10 | speaker housing |
| 11 | wire |
| 12 | headband attachment part |
| 13 | microphone attachment part |
| 14 | magnet |
| 15 | steel ring |
| 16 | first side of speaker housing |
| 17 | ear cushion |
| 18 | headband opening |
| 19 | centre axis |
| 20 | speaker |
| 21 | sound holes |
| 22 | arrow |
| 23 | first circular projection |
| 24 | second circular projection |
| 25 | inner side of first circular projection |
| 26 | outer side of first circular projection |
| 27 | inner side of second circular projection |
| 28 | outer side of second circular projection |
| 29 | inner side of steel ring |
| 30 | inner side of hole in ear pad |
| 31 | inner side of hole in ear plate |
| 32 | covering part of ear cushion |
| 33 | hole in steel ring |
| 34 | second side of ear cushion |
| 35 | ear pad hole |
| 36 | ear plate hole (sound passage) |
| 37 | ring-shaped recess in ear plate |
| 38 | microphone |
| 39 | first earphone side |
| 40 | second earphone side |
| 41 | first ear pad side |
| 42 | second ear pad side |
| 43 | third headband part |

MODES FOR CARRYING OUT THE INVENTION

Fig discloses an embodiment of a headset 1 according to the invention. The headset 1 is a wired communication headset of the duo type, which means that it comprises two earphones 2, 3. A headband 4 connects the two earphones 2, 3 and a microphone 38 is arranged at the free end of a microphone arm 5. The headband 4 is adapted to fit over the top of the user's head during use and hold the earphones 2, 3 on each ear. On the side facing the ear, an ear pad 8 is attached on each earphone 2, 3. Each earphone 2, 3 comprises a speaker housing 10, an ear plate 9 and a headband attachment part 12. The headband 4 comprises a first headband part 6, a second headband part 7 and a third headband part 43. The first and second headband parts 6, 7 are attached to the headband attachment part 12 of each earphone 2, 3. The third headband part 43 is telescopically received within the first and second headband parts 6, 7, such that the length of the headband 4 can be adjusted to the size of the user's head.

A wire 11 is attached to the speaker housing 10 of the second earphone 3 and connects the headset 1 to a telephone or computer. A not shown wire extends along or through the headband 4 between the first and the second earphone 2, 3.

The microphone arm 5 is rotatably attached to the second earphone 3 by means of a microphone attachment part 13, whereby the microphone arm 5 can be adjusted in relation to the mouth of the user.

Figure 2:
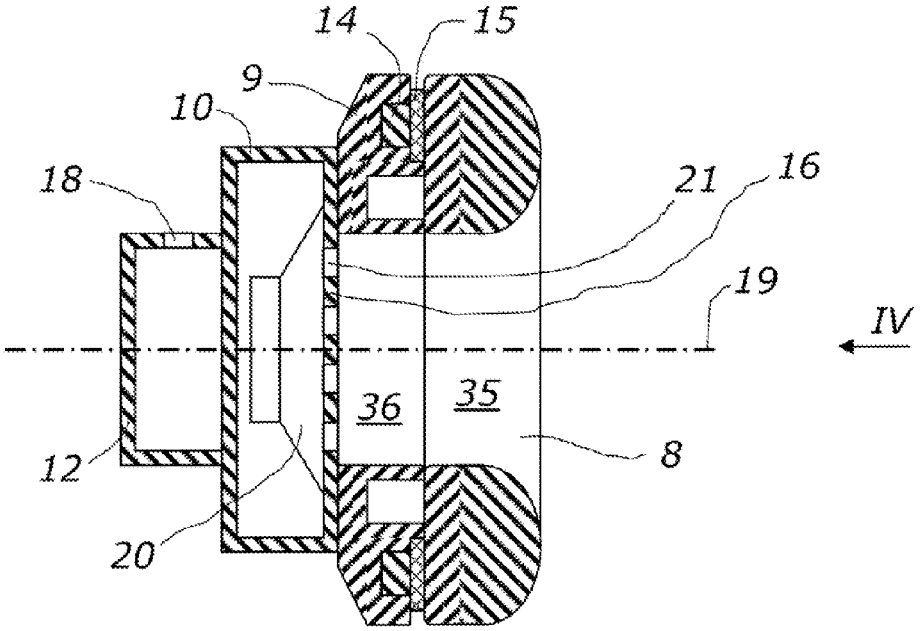
FIG. 2 is a sectional view through an earphone and an ear pad of the headset according to FIG. 1.

FIG. 2 discloses a sectional view through the first earphone 2 of FIG. 1. The speaker housing 10 contains a speaker 20 and audio from the speaker 20 is led through sound holes 21 in a first side 16 of the speaker housing 10, through an ear plate hole 36 and an ear pad hole 35 to the ear of the user.

A headband opening 18 in the headband attachment part 12 is used for attaching the first headband part 6 and receiving the wire extending along the headband 4 to the first earphone 2. The first headband part 6 and the wire are not shown for clarity reasons.

Figure 3:
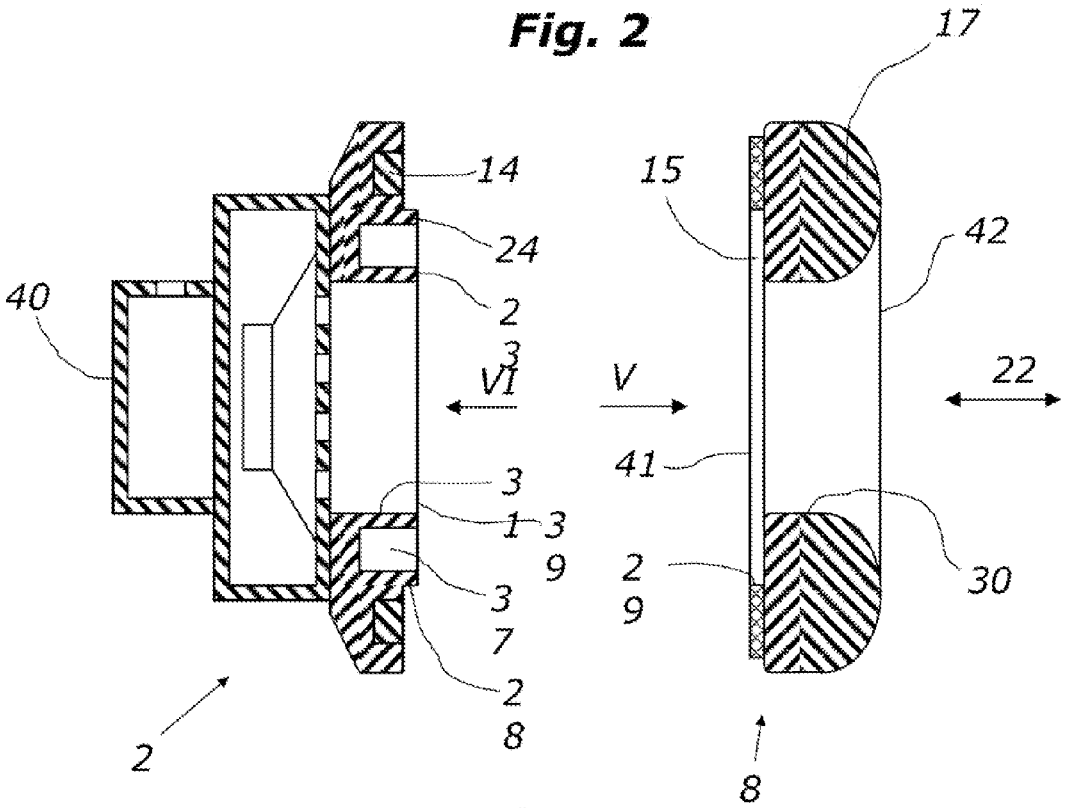
FIG. 3 is showing the same as FIG. 2, but the earphone and the ear pad are detached from each other.

In FIG. 3, the ear pad 8 is detached from the earphone 2. The earphone 2 and, thus the ear plate 14, has a first earphone side 39 facing the ear pad 8 and a second earphone side 40 facing away from the ear pad 8. The earphone 2 and the ear pad 8 are circular in a plane perpendicular to the centre axis 19 shown in FIG. 2.

The ear plate 9 comprises on the first earphone side 39 four permanent magnets 14, whereof two are visible in FIGS. 2 and 3.

The ear pad 8 comprises a first ear pad side 41 facing the earphone 2 and a second ear pad side 42 facing the user's ear during use. The ear pad 9 comprises a ring-shaped relatively soft ear cushion 17 with an inner side 30 surrounding the ear pad hole 35 and a flat steel ring 15 at the first ear pad side 41. The steel ring 15 is ferromagnetic, which means that it is attracted to the permanent magnets 14 of the ear plate 9. Thus, the ear pad 8 can be attached to the earphone 2 by magnetic force. In FIG. 2 it can be seen, that the magnets 14 and the steel ring 15 abuts each other. By pulling the ear pad 8 away with a certain force, the user can detach the ear pad 8 from the earphone 2. The ear plate 9 comprises a first circular projection 23 surrounding the ear plate hole 36. An inner wall 31 of the ear plate 9 bounds the ear plate hole 36. The ear plate 9 comprises a second circular projection 24 that lies outside the first circular projection 23. A ring-shaped recess 37 separates the first circular projection 23 and the second circular projection 24. The outer side 28 of the second circular projection 24 has a diameter that is slightly smaller than the inner diameter of the steel ring 15 of the ear pad 8. Thus, when the ear pad 8 is attached to the earphone 2 as shown in FIG. 2, the inner side 29 of the steel ring 15 defines a hole 33 that receives the second projection 24. In this way the projection 24 and the steel ring 15 work as mechanical positioning means preventing mutual displacement in a direction parallel with first earphone side 39 and the first ear pad side 41. In addition, these positioning means facilitates aligning the earphone 2 and the ear pad 8 during attaching. The positioning means could be embodied in different ways. Thus, a ring-shaped member on the ear pad 8 could be adapted to fit in the ear plate hole 36 or the ring-shaped recess 37 of the ear plate 9. Another solution would be an outer skirt protruding from the ear pad 8 or the earphone 2 and encircling the periphery of the other.

Figure 4:
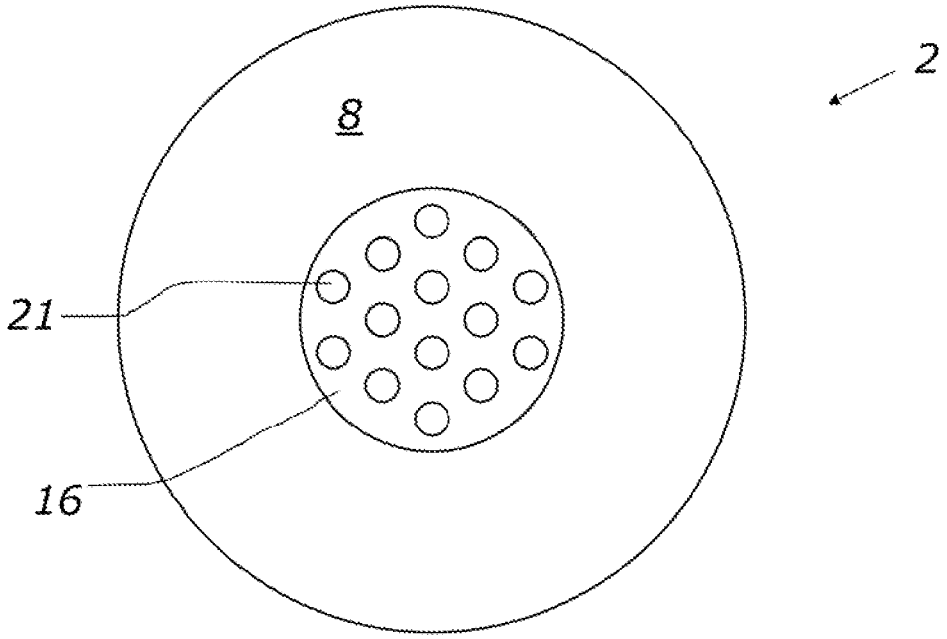
FIG. 4 is the earphone and the ear pad seen in the direction of the arrow IV in FIG. 2.

FIG. 4 discloses the earphone 2 with attached ear pad 8 from the second ear pad side 42. The first side 16 of the speaker housing 10 and the sound holes 21 in this first side 16 are visible through the ear pad hole 35.

Figure 5:
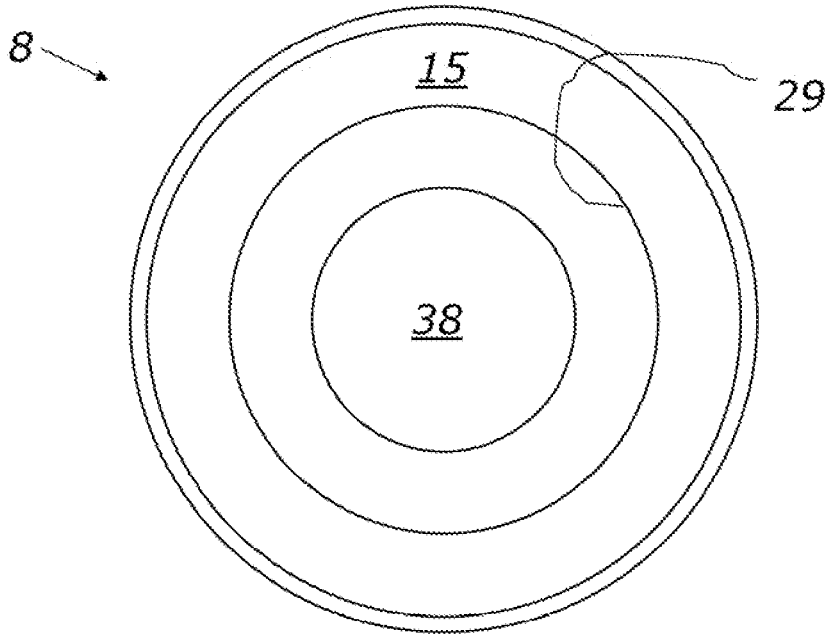
FIG. 5 is the ear pad seen in the direction of the arrow V in FIG. 3.
Figure 6:
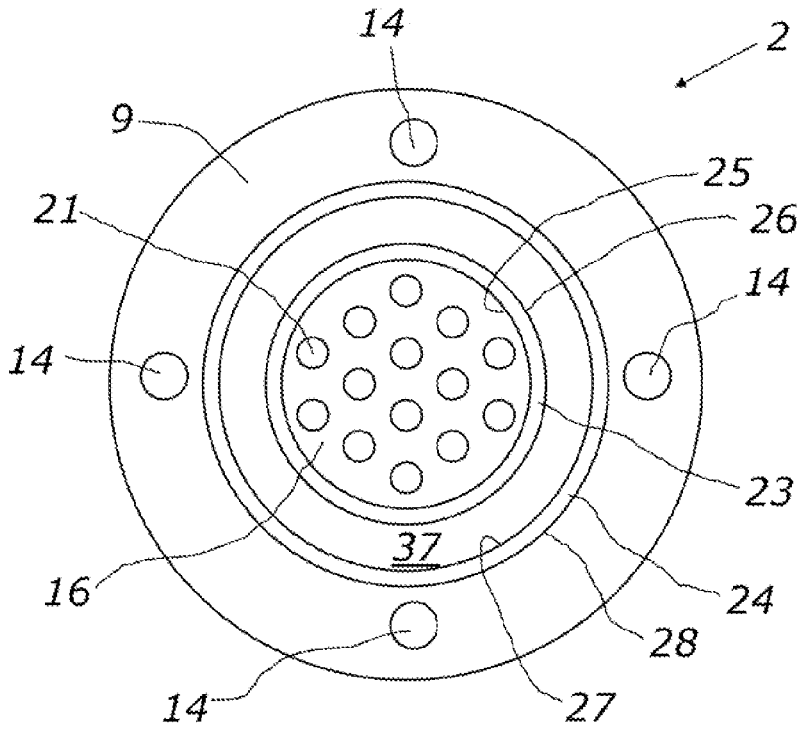
FIG. 6 is the earphone seen in the direction of the arrow VI in FIG. 3.

FIG. 5 discloses the ear pad 8 from the first ear pad side 41, and FIG. 6 discloses the earphone 2 from the first earphone side 39. As indicated, the ring-shaped recess 37 is bounded by the outer side 26 of the first circular projection 23 and the inner side 27 of the second circular projection 24. An inner side 25 of the first circular projection 24 coincides with the inner side 31 of the hole 36 in the ear plate 9.

Figure 7:
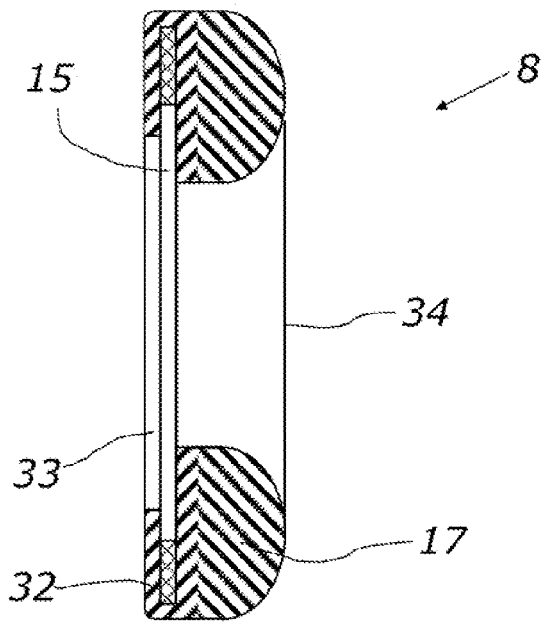
FIG. 7 is a sectional view through an ear pad according a second embodiment of the invention, FIG. 8 an ear phone and an ear pad according to third embodiment shown in the same way as in FIG. 4, and FIG. 9 the ear pad according to the third embodiment shown in the same way as in FIG. 5.

FIG. 7 is a sectional view through an ear pad 8 according a second embodiment of the invention. The ear pad 2 differs from the ear pad according to the first embodiment by the steel ring 15 being embedded in the ear cushion 17 and thus covered by a covering part 32 of the ear cushion 17. Thus, the steel ring 15 is better protected and can be more firmly attached to the ear cushion 17.

Figure 8:
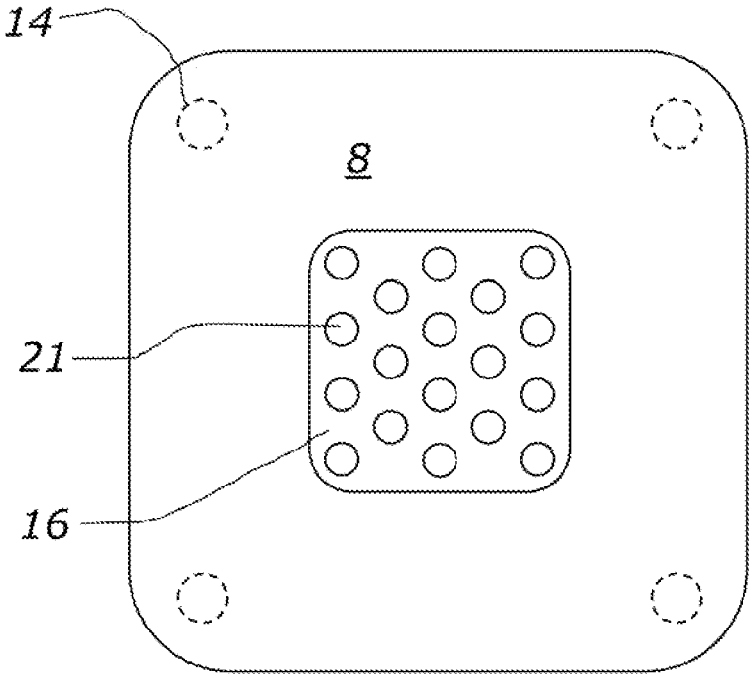
Figure 9:
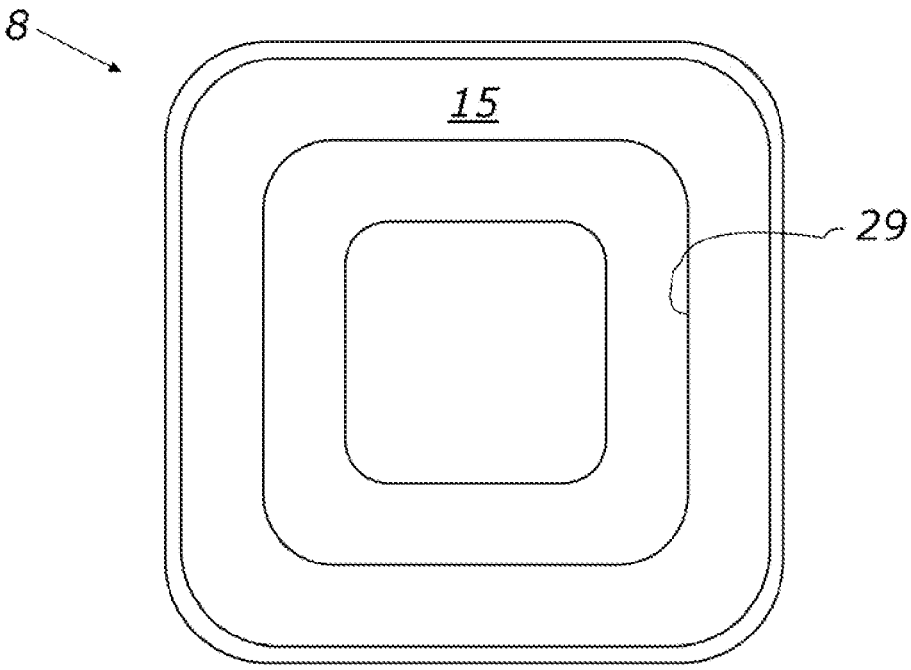

FIG. 8 discloses an end view of a third embodiment, wherein the earphone 2 and the ear pad 8 are square. A permanent magnet 14 is arranged in each corner of the earphone 2. FIG. 9 discloses the ear pad 8 of the third embodiment from the first side 41, and it can be seen that the steel ring 15 is square.

The invention is not limited to the embodiments described above. Thus, the headset can be a mono-headset with only one earphone, a headset without a microphone. In addition, the wearing device can be the integrated with the earphone and/or the ear pad, such that the headset is attached to the head of the user by being inserted to in the ear. Thus, the ear pad also covers embodiments, which normally are referred to as ear buds.

In addition, the ear pad can be provided with one or permanent magnets and the earphone with magnetic elements of soft magnetic material. Alternatively, both the earphone and the ear pad could be provided with permanent magnets.

Although a wired headset is described here, it could as well be a wireless headset, e.g. communicating with another telecommunication device by wireless Bluetooth or DECT technology.

The invention claimed is:

1. A headset comprising:

at least one earphone having a sound transmitter having a sound transmitting aperture, and earphone attachment portion on attached thereto, said attachment portion having an outer peripheral edge and a central sound transmitting aperture;

a removable ear pad, having an attachment plate and a central sound receiving aperture having an inner periphery defining the diameter of the aperture opening, said plate having an annular recess coaxial with said receiving aperture but having a diameter larger than said sound receiving aperture;

said attachment portion having an annular orthogonal projection extending therefrom and being coaxial with said sound transmitting aperture, said projection sized to be received in said recess when said attachment portion and plate are brought together for fixing the position of the ear pad with said ear pad attachment portion and to prevent mutual displacement of said portion and plate; said attachment portion further including an inner peripheral concentric annual projection sized to be received within said sound receiving aperture, thereby creating a sound passage shield of uniform diameter between said sound transmitter and said ear pad, so that sounds from said transmitter are delivered to said ear pad while minimizing sound losses therebetween.

2. A headset according to claim 1, wherein the headset further comprises an ear pad with magnetic ear pad attachment.

3. A headset according to claim 2, wherein the ear pad attachment portion comprises a magnetic ear pad attachment element of ferromagnetic material extending along the periphery of a first ear pad side, which faces the first earphone side, when the ear pad is attached to earphone.

4. A headset according to claim 3, wherein the periphery of the first ear pad side is circular and the ear pad attachment element is ring-shaped.

5. A headset according to claim 3, wherein the earphone attachment comprise a plurality of permanent magnets.

6. A headset according to claim 5, wherein the earphone attachment comprise a number of permanent magnets arranged around a sound passage at the first earphone side.

7. A headset according to claim 1, wherein the earphone and the ear pad comprise mechanical positioner for preventing mutual displacement in a direction parallel with first earphone side and the first ear pad side.

8. A headset according to claim 7, wherein the mechanical positioner comprises a protrusion and a co-operating recess.

9. A headset according to claim 1, wherein the ear pad comprises a ring-shaped ear cushion.

10. A headset according to claim 1, wherein the wearing device is a headband or neckband, and wherein the headset comprises two earphones interconnected by the wearing device.

11. The earphone of claim 1, wherein said shield joins said sound transmitter to said attachment plate and wherein, said projections are in the form of a contiguous ring extending without gaps from said sound transmitter to said inner periphery of said ear pad, and wherein said shield is coaxial with and inside said projection ring.

12. The earphone of claim 1, wherein said projections are in the form of a contiguous ring.

13. The earphone of claim 1, wherein said attachment portion includes recesses containing a plurality of magnets and wherein said attachment plate is ferromagnetic so that said ear piece is attracted to said portion when brought together.

14. A headset comprising:

at least one earphone having a sound transmitter and earphone attachment portion on attached thereto, said portion having an outer peripheral edge and a central sound transmitting aperture;

a removable ear pad, having a ferromagnetic attachment plate concentric with a peripheral edge and having a first inner periphery defining a recess adjacent thereto, a central sound receiving aperture having a second inner periphery defining the minimum opening diameter of the aperture, wherein said first inner periphery has a diameter larger than said second inner periphery;

said attachment portion having at least one magnet located to engage said plate when brought into proximity and an orthogonal projecting concentric wall having an outer wall surface and an inner wall surface, said outer wall surface sized to be received in said recess and said inner wall surface sized to be received in said central sound receiving aperture, said outer wall surface engaging with said recess thereby preventing mutual displacement of said portion and the ear pad; and said inner wall surface providing a shielded sound passage of uniform diameter from said sound transmitter to said ear pad while minimizing sound losses therebetween.

15. The headset of claim 14 wherein said at least one magnet includes a plurality of magnets spaced around said attachment portion.

16. A headset comprising:

at least one earphone having a sound transmitter and earphone attachment portion on attached thereto, said portion having an outer peripheral edge and a central sound transmitting aperture;

a removable ear pad, having an attachment plate concentric with a peripheral edge and having a first inner periphery defining a recess adjacent there, a central sound receiving aperture having a second inner periphery defining the minimum opening diameter of the aperture, wherein said first inner periphery has a diameter larger than said second inner periphery;

said attachment portion having an orthogonal projecting concentric wall having an outer wall surface and an inner wall surface, said outer wall surface sized to be received in said recess and said inner wall surface sized to be received in said central sound receiving aperture, said outer wall surface engaging with said recess thereby preventing mutual displacement of said portion and the ear pad; and said inner wall surface providing a shielded sound passage of uniform diameter from said sound transmitter to said ear pad while minimizing sound losses therebetween.

17. The headset of claim 16 wherein said orthogonal projecting concentric wall includes a pair of concentric walls of different diameters.

* * * * *